United States Patent [19]

Ewing

[11] 3,989,993

[45] Nov. 2, 1976

[54] DRIVE AND CONTROL MECHANISM FOR ELECTRICALLY OPERATED RECIPROCATING APPARATUS

[75] Inventor: Roy D. Ewing, Richardson, Tex.

[73] Assignee: United States Steel Corporation, Pittsburgh, Pa.

[22] Filed: Dec. 6, 1974

[21] Appl. No.: 530,316

[52] U.S. Cl. ..... 318/282

[51] Int. Cl.[2] ..... H02P 7/20

[58] Field of Search ..... 318/256, 266, 282, 286, 318/466–468

[56] References Cited

UNITED STATES PATENTS

| | | | |
|---|---|---|---|
| 1,971,865 | 8/1934 | Matthews | 318/282 |
| 2,312,178 | 2/1943 | Levison et al. | 318/282 X |
| 2,377,743 | 6/1945 | Arutunoff | 318/282 X |
| 2,913,651 | 11/1959 | Smith et al. | 318/282 |
| 3,345,950 | 10/1967 | Bender | 318/282 X |

*Primary Examiner*—Robert K. Schaefer
*Assistant Examiner*—W. E. Duncanson, Jr.
*Attorney, Agent, or Firm*—Walter P. Wood

[57] ABSTRACT

A drive and control mechanism for an electrically operated reciprocating apparatus, intended especially for a long-stroke well-pumping apparatus. The mechanism automatically controls the direction of travel of the apparatus and effects reversals at the ends of each stroke. On start-up the apparatus always travels in a direction toward its farther limit of travel. Control is effected without series of sequentially operating relays which can shut down the apparatus unnecessarily in the event any one relay drops out accidentally, as can result from a voltage drop. The circuit includes protective means for shutting down the apparatus immediately in the event certain malfunctions occur, for example, if the parts travel beyond proper limits, or if the apparatus commences to operate at excessive speed, or if a motor overheats.

23 Claims, 10 Drawing Figures

DRIVE AND CONTROL MECHANISM FOR ELECTRICALLY OPERATED RECIPROCATING APPARATUS

This invention relates to an improved drive and control mechanism for an electrically operated reciprocating apparatus.

Although the invention has broader application, the mechanism is particularly useful for driving and controlling a long-stroke well-pumping apparatus of the type shown in Kuhns and Rizzone U.S. Pat. No. 3,285,081 of common ownership. When used with this apparatus, the invention is an improvement over the drive and control mechanism illustrated in said patent. The apparatus shown in the patent comprises a tower, a driven shaft journaled to the tower at its upper end, and a pair of drums carried by the shaft. Outboard and inboard cables are connected to each drum to wind thereon. The two outboard cables are connected to a string of sucker rods which extend to a subsurface pump within a well. The two inboard cables are connected to a counterbalance which rides up and down within the tower. The shaft and drum rotate alternately in opposite directions to move the rod string through upstrokes and downstrokes, with the counterbalance always traveling in the opposite direction from the rod string.

Each side of each drum has a respective eccentric portion or ramp which the cables meet as they are almost unwound from the drums near the ends of the strokes. When the rod string has almost completed an upstroke, the drive to the shaft is turned off and the stroke is completed under momentum of the parts. At this point in the operating cycle, the outboard rod string cables are almost fully wound on the drums, while the inboard counterbalance cables are almost fully unwound and meet the ramps. Consequently the rod string cables have longer moment arms, whereby weight distribution alone starts the ensuing downstroke. Presently the drive is turned on in the opposite direction. The reverse action takes place at the end of a downstroke of the rod string.

This apparatus has an advantage over the more common walking-beam pumping units that it enables a subsurface pump to make much longer strokes and thus operate more efficiently. Until recently a stroke of 100 inches was considered long for a walking beam, although longer stroke walking beam units have been developed. There is no necessary limit to the length of strokes obtained in the apparatus of the patent, but a stroke of 34 feet has been used in practice. One problem has been in the development of a completely reliable drive and control mechanism. The apparatus preferably is electrically driven and must operate unattended for long periods. If the drive mechanism fails, the apparatus of course ceases to operate. In the event certain malfunctions occur, the apparatus should be shut down immediately to minimize the damage. However, a control mechanism which relies on a series of relays to effect stops and reversals has not proved to be sufficiently reliable, since any one relay of the series may accidentally drop out and unnecessarily shut down the whole apparatus. This can occur, for example, if there is a small voltage drop in the power supply.

An object of the present invention is to provide an improved and reliable drive and control mechanism for an electrically operated reciprocating apparatus, which mechanism automatically turns off the power to the apparatus near ends of strokes in each direction and, after a suitable pause to enable a reversal to take place, automatically applies power to the apparatus in the opposite direction.

A further object is to provide a drive and control mechanism which accomplishes the foregoing object, the circuit of which embodies a latch-type relay, avoiding need for a series of relays dependent on one another wherein any one relay in the series may drop out accidentally and shut down the apparatus.

A further object is to provide an improved drive and control mechanism for an electrically operated reciprocating apparatus, which mechanism includes directional control means assuring that, on start-up following a shut-down, the apparatus always travels toward its farther limit of travel, regardless of which direction it happened to be traveling when shut down.

A further object is to provide a drive and control mechanism which accomplishes the foregoing objects and which is equipped with protective devices effective to shut down the apparatus immediately in the event certain malfunctions occur, for example, if the parts travel beyond proper limits, or if the apparatus commences to operate at excessive speed, or if a motor overheats.

PUMPING APPARATUS

Figure 1:
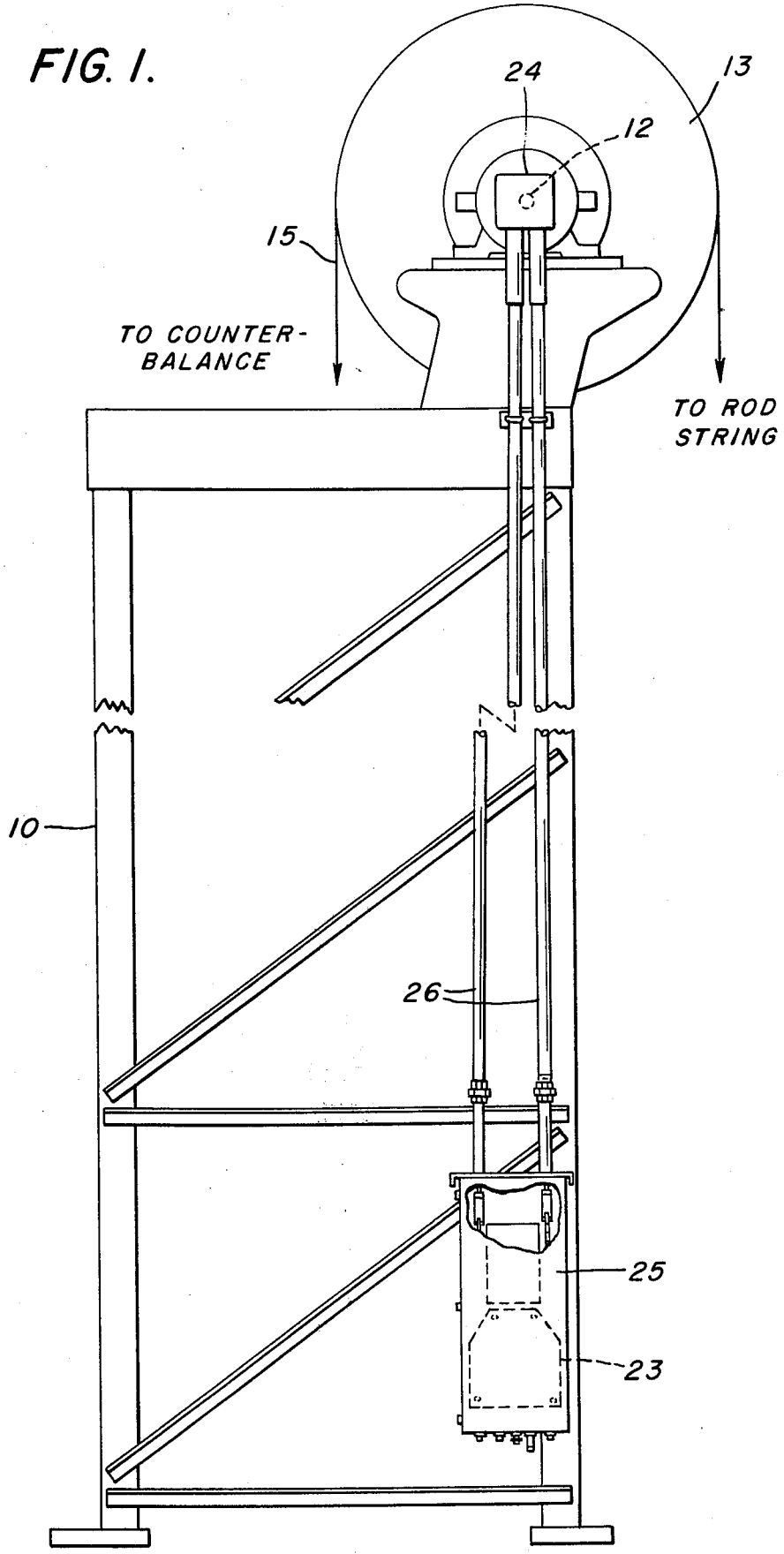
FIG. 1 is a diagrammatic side elevational view of a portion of a pumping apparatus embodying the principles of the aforementioned patent, but illustrating a preferred means for operating the switches which actuate my control and drive mechanism.
Figure 2:
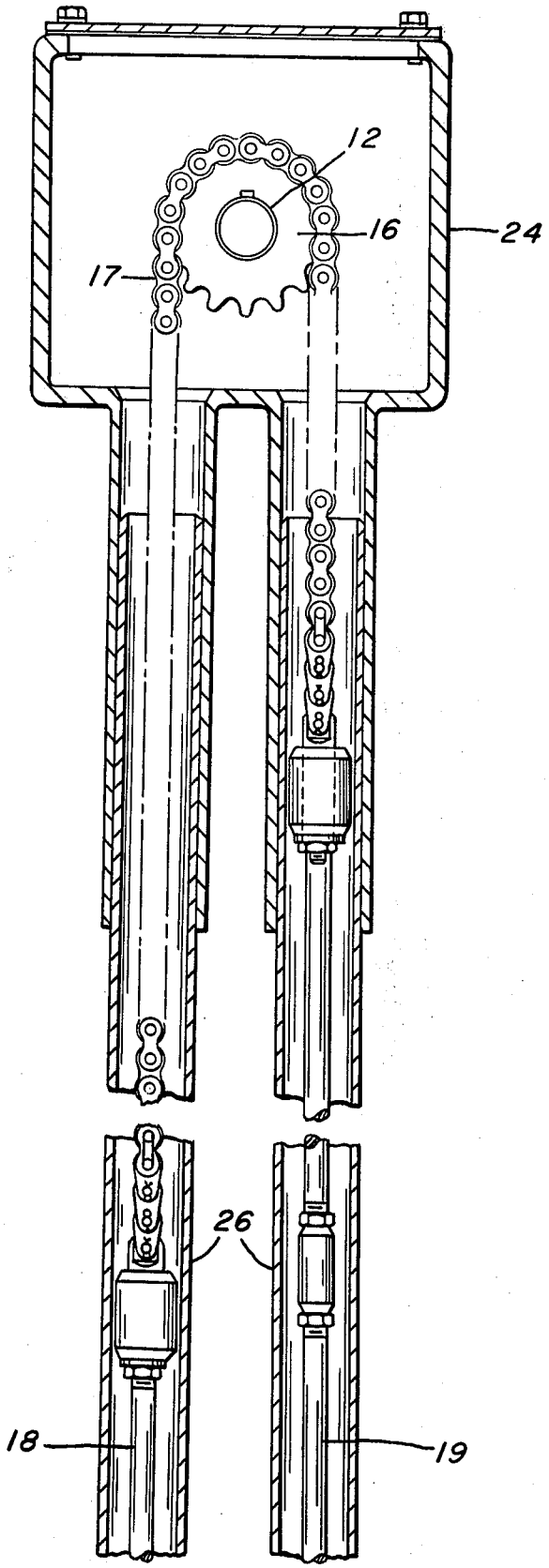
FIG. 2 is a vertical sectional view on a larger scale of the means operatively connecting the drum shaft with the switching device.
Figure 3:
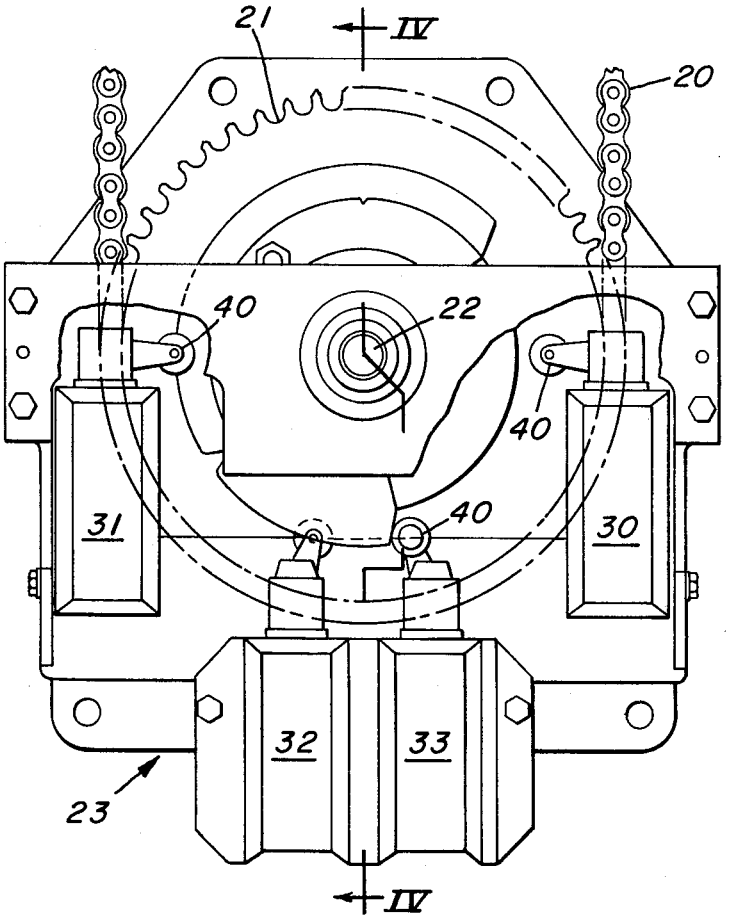
FIG. 3 is a side elevational view of the switching device.

FIG. 1 shows a pumping apparatus which includes a tower 10, a shaft 12 journaled at the top of the tower, drums 13 carried by the shaft, and outboard and inboard cables 14 and 15 extending from the drums to a string of sucker rods and to a counterbalance respectively (not shown). These parts can be similar to corresponding parts shown in the Kuhns and Rizzone patent. As shown in FIG. 2, shaft 12 carries a sprocket 16 over which runs a chain 17 connected at its ends to the upper ends of downwardly extending rod 18 and 19. As shown in FIG. 3, a second chain 20 is connected to the lower ends of these rods and runs over a sprocket 21 carried by a shaft 22 of a switching device 23. The ratio of the number of teeth on the two sprockets is such that sprocket 16 rotates through several revolutions while rotating sprocket 21 through only a fractional revolution. The sprocket 16 and switching device 23 are housed within boxes 24 and 25 respectively, and the rods 18 and 19 within tubes 26. The switching device is located at the bottom of the tower, making it unnecessary for an individual to climb the tower to adjust or maintain the switches.

SWITCHING DEVICE

Figure 4:
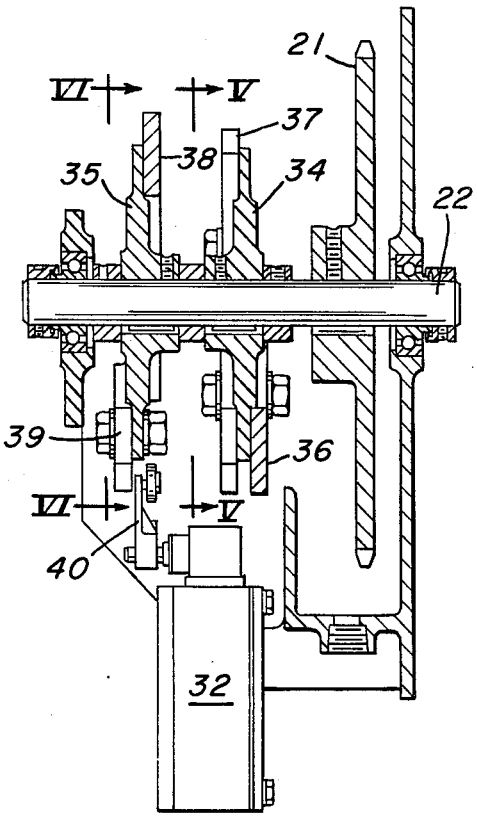
FIG. 4 is a vertical section on line IV—IV of FIG. 3.
Figure 6:
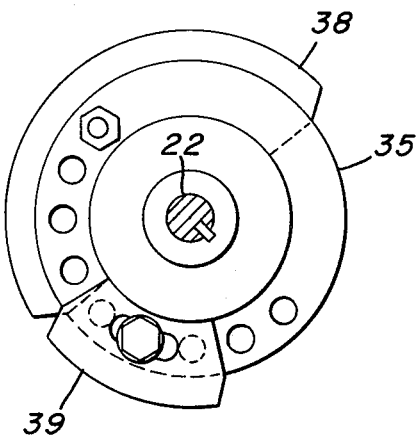
FIG. 6 is a vertical section on line VI—VI of FIG. 4.
Figure 5:
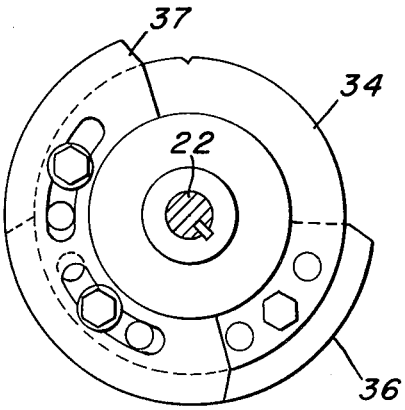
FIG. 5 is a vertical section on line V—V of FIG. 4.

As shown in FIG. 3, the switching device 23 includes top and bottom limit switches 30 and 31, a directional control switch 32, and an overtravel switch 33. The designation of the limit switches as "top" and "bottom" refers to counterbalance travel; that is, the top and bottom limit switches, which are normally open, close when the counterbalance approaches the upper and lower limits respectively of its travel. As best shown in FIG. 4, shaft 22 carries a pair of discs 34 and 35. Disc 34 carries on its opposite faces cams 36 and 37 for operating the top and bottom limit switches 30 and 31 respectively (FIG. 5). Disc 35 carries on its opposite faces cams 38 and 39 for operating the directional control switch 32 and the overtravel switch 33 respectively (FIG. 6). The switches 30, 31, 32 and 33 have respective operating arms 40 cooperable with the cams. The cams are adjustably bolted to the discs to permit adjustment in the points at which each switch is actuated during the operating cycle. In the circuit illustrated, cam 38 remains in engagement with the operating arm of the directional control switch 32 whenever the counterbalance is below the approximate midpoint of its travel and remains disengaged whenever the counterbalance is above. The overtravel switch 33 remains open during normal operation of the apparatus, but cam 39 closes this switch if the counterbalance travels beyond its proper limit in either direction.

CONTROL PORTION OF CIRCUIT

Figure 7:
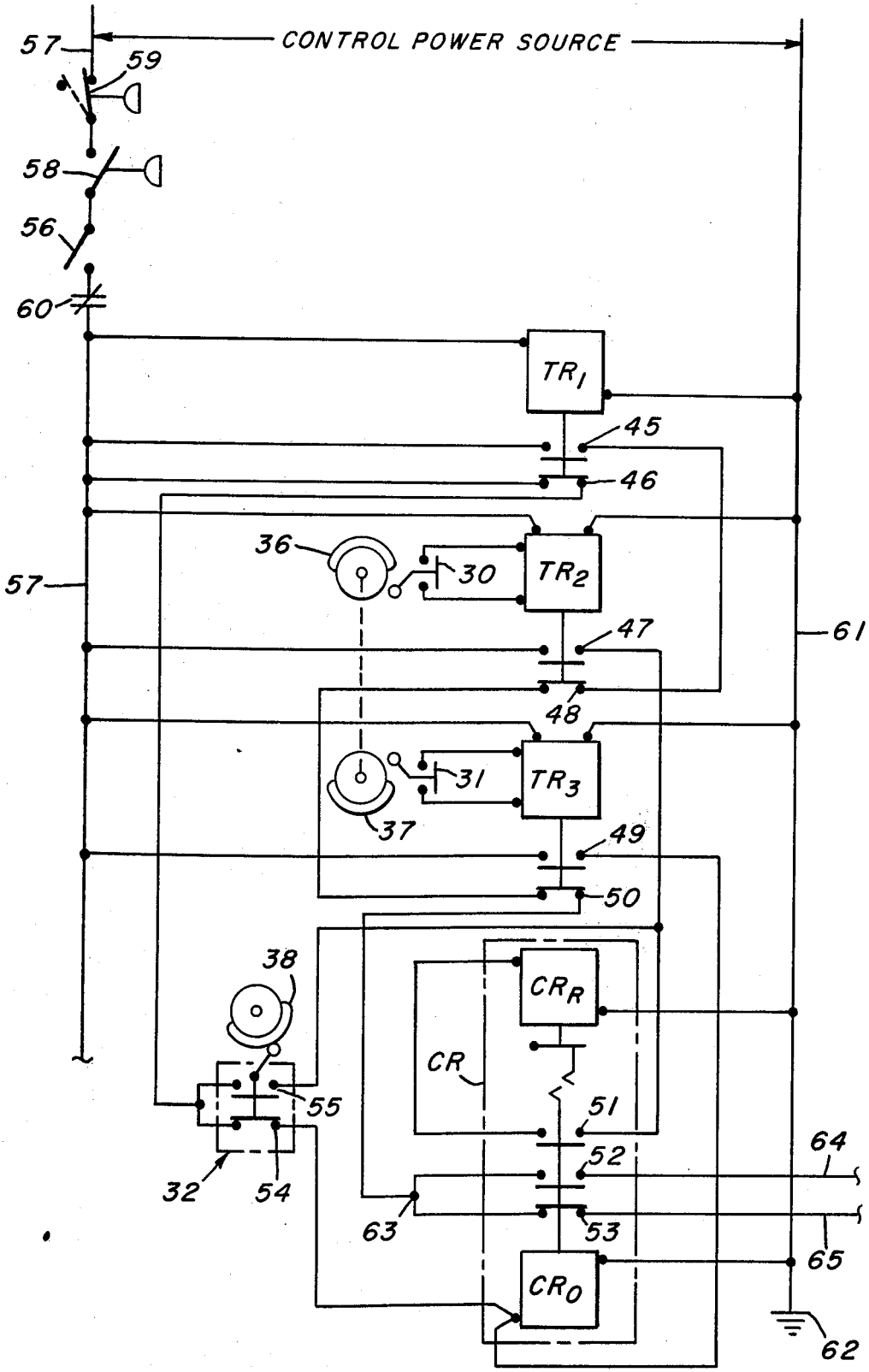
FIG. 7 is a schematic wiring diagram of the control portion of the circuit embodied in the mechanism.

As shown in FIG. 7, the control portion of the electric circuit includes three timing relays $TR_1$, $TR_2$, and $TR_3$, and a control relay CR. $TR_1$ is a conventional time-delay relay, the contacts of which reverse their position at the conclusion of a predetermined interval following energization of the coil. $TR_2$ and $TR_3$ are special time-delay relays, the coils of which have both supply and control terminals. Energizing the coil through the supply terminals sets up the relay. Thereafter the relay picks up as soon as a connection is established between its control terminals, whereupon the position of its contacts changes. After either relay picks up, its contacts return to their normal positions at the conclusion of a predetermined interval. It is characteristic of these relays: (1) that the relay picks up and goes through its timing cycle immediately following establishment of a connection between its control terminals, regardless of whether the connection is only momentary or is sustained, provided the coil is energized via its supply terminals at the time the connection is established; and (2) that the relay does not pick up if a connection already exists between the control terminals at the time the coil is energized via the supply terminals. I connect the normally open top and bottom limit switches 30 and 31 across the control terminals of $TR_2$ and $TR_3$ respectively. If the coil of either relay is energized through its supply terminals, the relay picks up when cam 36 or 37 closes the corresponding limit switch. The interval during which the contacts are reversed defines the interval the drive is turned off at the conclusion of counterbalance travel in each direction. CR is a latch-type relay which has operating and release coils $CR_O$ and $CR_R$ respectively. When $CR_O$ is energized, the contacts of the relay change positions and mechanically latch positively in their new positions until $CR_R$ is energized, whereupon they return to their normal positions and so remain until $CR_O$ again is energized. Relays of both types are known and are available commercially. One example of a relay suitable for $TR_2$ and $TR_3$ is available from Potter and Brumfield Division of American Machine and Foundry Company, Princeton, Indiana, Type CHB38-70011. One example of a relay suitable for CR is available from Struthers Dunn, Inc., Pitman, New Jersey, Style A255XBXP.

$TR_1$ has normally open contacts 45 and normally closed contacts 46. $TR_2$ has normally open contacts 47 and normally closed contacts 48. $TR_3$ has normally open contacts 49 and normally closed contacts 50. CR has normally open contacts 51 and 52 and normally closed contacts 53. The directional control switch 32 is a double-throw switch having parallel contacts 54 and 55. Contacts 54 close and contacts 55 open whenever cam 38 is in engagement with switch 32. Similarly contacts 54 open and contacts 55 close whenever cam 38 is not in engagement with switch 32. As already stated, the cam engages the switch whenever the counterbalance is below its approximate midposition, and moves out of engagement whenever the counterbalance is above.

I connect an "on-off" switch 56 in a conductor 57 which leads from a power source and contains pressure switches 58 and 59 in series preceding switch 56, and normally closed contacts 60 following switch 56. Switches 58 and 59 and contacts 60 are in the protective portion of the circuit hereinafter described. In an alternative arrangement, also hereinafter described, contacts 60 are replaced by normally open contacts which close only if the apparatus is in readiness to start. I connect one side of the coils of each $TR_1$, $TR_2$ and $TR_3$ in parallel to conductor 57. I connect the other side of each of these coils and also one side of each coil $CR_O$ and $CR_R$, via a conductor 61 to a ground 62. I also connect conductor 57 via the normally open contacts 45 and normally closed contacts 48 and 50 of $TR_1$, $TR_2$, and $TR_3$ respectively in series to a junction point 63. I connect the junction point 63 via the normally open contacts 52 and normally closed contacts 53 of CR to parallel conductors 64 and 65 which lead to the drive portion of the circuit hereinafter described. I also connect conductor 57 via the normally closed contacts 46 of $TR_1$ to one side of each of the parallel contacts 54 and 55 of the directional control switch 32. I connect the other side of contacts 54 to $CR_O$, and the other side of contacts 55 to $CR_R$, the latter via the normally open contacts 51 of CR. I also connect conductor 57 to one side of each of the normally open contacts 47 and 49 of $TR_2$ and $TR_3$. I connect the other side of contacts 47 to $CR_R$ via contacts 51 to provide a current path in parallel with the path through contacts 46 and 55. I connect the other side of contacts 49 to $CR_O$ to provide a current path in parallel with the path through contacts 46 and 54.

OPERATION OF THE CONTROL PORTION OF THE CIRCUIT

The directional control means assures that, on start up following a shut-down, the counterbalance always travels toward its farther limit of travel, regardless of which direction it happened to be traveling when shut down. There is a possibility that the apparatus may be shut down at points in its operating cycle at which cam 36 or 37 has engaged the top or bottom limit switch 30 or 31, but before the reversal has taken place. If the counterbalance were to continue to travel in its original direction on the next start-up, no reversal would take place and the overtravel switch would operate to shut down the apparatus once more, as hereinafter described. When the drive motor first starts, a momentary surge of current passes therethrough. If the counterbalance were to travel toward its nearer limit of travel on start-up, the current surge could drive the parts too rapidly and carry them beyond the limit.

In the ensuing description, I assume that everything in the protective portion of the circuit is in order, whereby it does not prevent a start-up. Thus switch 58 is closed, switch 59 is in the position illustrated, and contacts 60 are closed.

I assume first the apparatus was last shut down with the counterbalance below its midposition and traveling downwardly, whereby contacts 51, 52, 53, 54 and 55 are in the positions illustrated. Closing the "on-off" switch 56 now completes current paths: (a) via contacts 60, through the coil of $TR_1$, via conductor 61 to ground 62; (b) via contacts 60, through the supply terminals of the parallel coils of $TR_2$ and $TR_3$ to ground 62; and (c) via contacts 60, 46 and 54 through $CR_O$ to ground 62. $TR_1$ starts its timing cycle. $CR_O$ is energized, whereupon contacts 53 open and contacts 51 and 52 close and latch in their new positions. After a short interval $TR_1$ times out, whereupon contacts 45 close and contacts 46 open and remain in these positions throughout the normal operating cycle. Closing of contacts 45 completes a current path from conductor 57 via contacts 45, 48 and 50, junction point 63, contacts 52 and conductor 64 to the drive portion of the circuit for driving the counterbalance upwardly. Opening of contacts 46 deenergizes $CR_o$, but does not change the position of its latched-in contacts. The directional control switch 32 is disconnected and remains so until the next start-up takes place. Completion of current paths through the coils of $TR_2$ and $TR_3$ via their supply terminals sets up these relays. The coils remain energized via their supply terminals throughout the operating cycle, but as already explained, neither $TR_2$ or $TR_3$ acts until the limit switch 30 or 31 closes and establishes a connection between its control terminals. The operation would be the same regardless of whether the bottom limit switch 31 is open or closed at the time of start-up. If switch 31 is closed, $TR_3$ would have timed out and its contacts returned to their normal positions during the shut-down period.

When the counterbalance almost completes its ascent, cam 36 closes the top limit switch 30, which establishes a connection between the control terminals of $TR_2$, whereupon contacts 48 open and contacts 47 close. Opening of contacts 48 interrupts the current path to the drive portion of the circuit, whereupon the parts coast to a stop. Closing of contacts 47 completes a current path from conductor 57 via contacts 47 and 51 through $CR_R$ to ground 62. Thus $CR_R$ is energized, releasing the latch, whereupon contacts 51, 52 and 53 return to the normal positions illustrated. Opening of contacts 52 and closing of contacts 53 set up a current path to the drive portion of the circuit for driving the counterbalance downwardly, but there is a pause since contacts 48 remain open. After a short interval while the weight distribution starts the counterbalance moving downwardly and $TR_2$ times out, contacts 48 again close and contacts 47 open. Closing of contacts 48 completes the same current path hereinbefore described to the junction point 63, but therebeyond via contacts 53 and conductor 65 for driving the counterbalance downwardly. $CR_R$ is energized only momentarily, since contacts 51 open immediately after it is energized.

When the counterbalance almost completes its descent, cam 37 closes the bottom limit switch 31, which establishes a connection between the control terminals of $TR_3$, whereupon contacts 50 open and contacts 49 close. Opening of contacts again interrupts the current path to the drive portion of the circuit, whereupon the parts coast to a stop as before. Closing of contacts 49 completes a current path from conductor 57 via contacts 49 through $CR_O$ to ground 62. Thus $CR_O$ is energized, whereupon as before contacts 51, 52 and 53 move to positions opposite those illustrated and latch in their new positions. Closing of contacts 52 and opening of contacts 53 set up the previously described current path to the drive portion of the circuit for driving the counterbalance upwardly, but again there is a pause since contacts 50 remain open. After a short interval while the weight distribution starts the counterbalance moving upwardly and $TR_3$ times out, contacts 50 close and contacts 49 open. Closing of contacts 50 completes the current path to the drive portion of the circuit as first described. $CR_O$ is energized only momentarily during the interval while $TR_3$ is energized and contacts 49 remain closed.

If the counterbalance was below its midposition and traveling upwardly when the apparatus was last shut down, contacts 54 and 55 of the directional control switch 32 are in the position illustrated, but contacts 51, 52 and 53 of CR already are latched in positions opposite those illustrated. The operation proceeds as just described, except that the brief energization of $CR_O$ while $TR_1$ times out has no effect.

If the counterbalance was above its midposition, and traveling downwardly when the apparatus was last shut down, contacts 51, 52 and 53 of CR are in the positions illustrated, but contacts 54 and 55 of the directional control switch 32 are in positions opposite those illustrated. Closing the "on-off" switch 56 now completes current paths (a) through the coil of $TR_1$ as before and (b) through the coils of $TR_2$ and $TR_3$ via their supply terminals as before. No current path is completed through $CR_O$, since contacts 54 are open; hence contacts 51, 52 and 53 remain in the positions illustrated. When $TR_1$ times out and contacts 45 close, the current path is completed from conductor 57 via contacts 45, 48 and 50, junction point 63, contacts 53 and conductor 65 to the drive portion of the circuit. Thereafter the operation proceeds as before.

If the counterbalance was above its midposition and traveling upwardly when the apparatus was shut down, the contacts 54 and 55 of the directional control switch 32 and the contacts 51, 52 and 53 of CR all are in positions opposite from those illustrated. Contacts 51, 52 and 53 remain latched in these positions during the period of shut-down, since $CR_R$ is not energized. On the next start-up a current path is completed from conductor 57 via contacts 46, 55, 51 through $CR_R$ to ground 62, whereupon the latch is released and contacts 51, 52 and 53 return to the positions illustrated for driving the counterbalance downwardly, and the operation proceeds as before.

DRIVE PORTION OF CIRCUIT

Figure 8:
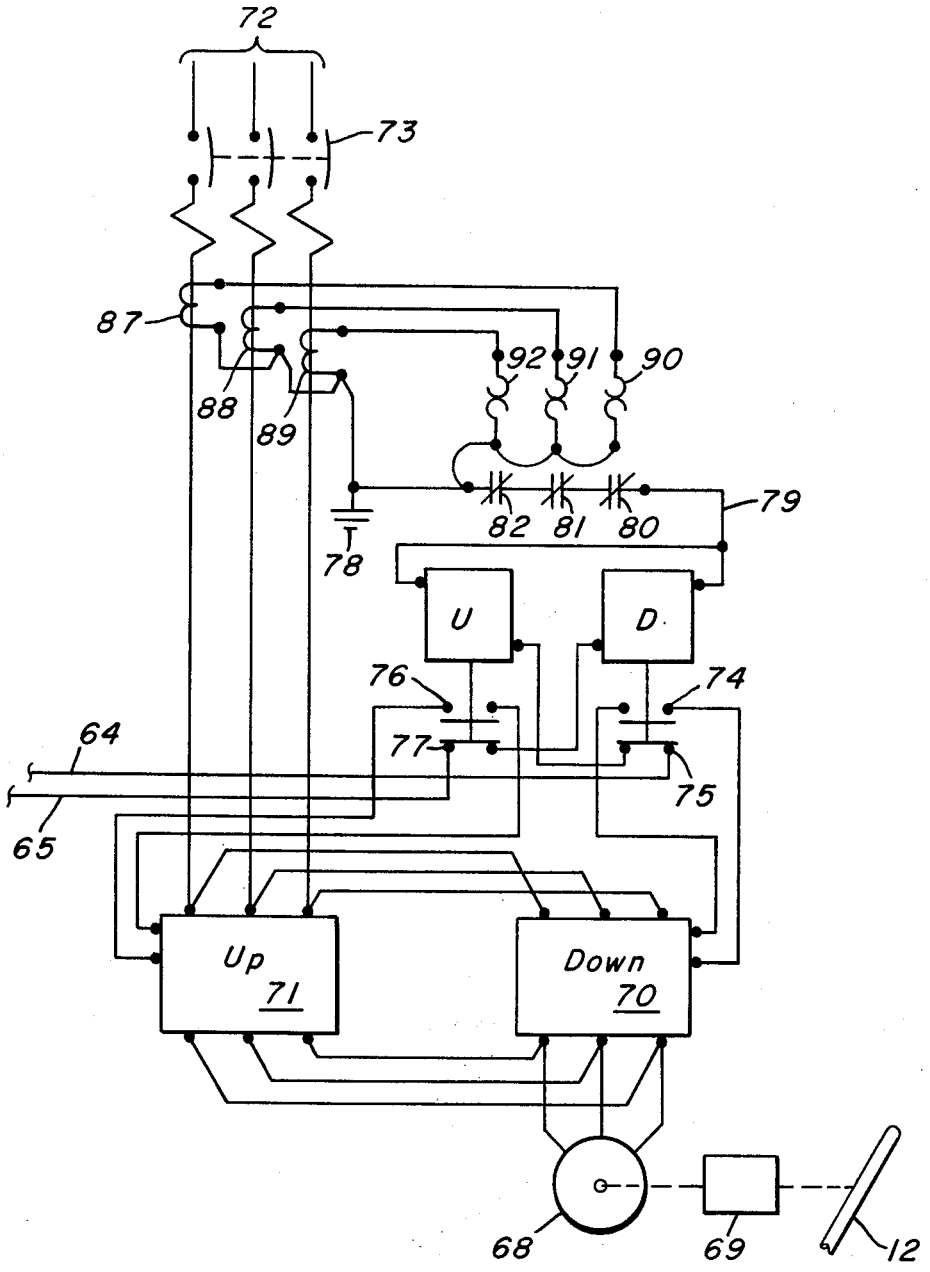
FIG. 8 is a schematic wiring diagram of the drive portion of the circuit embodied in the mechanism.

As shown in FIG. 8, the drive portion of the circuit includes a reversible electric motor 68 operatively connected with the drum shaft 12 through suitable reduction gearing 69, and "down" and "up" starters 70 and 71 electrically connected with the motor. The motor 68 illustrated is a conventional 3-phase induction motor. The starters 70 and 71 preferably are solid state commercially available devices. One example of a suitable starter is available from Electric Regulator Corp., Norwalk, Connecticut, as the "Statohm" equipped with a current regulator to to reduce the surge of current through the motor on each start. I connect 3-phase power supply lines 72 to the two starters for energizing motor 68 when either starter is actuated, as known in the art. A main circuit breaker 73 is connected in lines 72.

The drive portion of the circuit includes "down" and "up" relays D and U respectively. Relay D has normally open contacts 74 and normally closed contacts 75. Similarly relay U has normally open contacts 76 and normally closed contacts 77. I connect the conductor 65 from the control portion of the circuit to one side of the coil of the "down" relay via the normally closed contacts 77 of the "up" relay. Similarly I connect the conductor 64 to one side of the coil of the "up" relay via the normally closed contacts 75 of the "down" relay. Hence neither relay can be energized if the other already is energized. I connect the other sides of the coils of both the "down" and "up" relays D and U to a ground 78. The connection is via a conductor 79 which contains normally closed contacts 80, 81 and 82 hereinafter described. The normally open contacts 74 and 76 of relays D and U are in the actuating circuits of starters 70 and 71 respectively, whereby either starter is actuated to start the motor 68 in the appropriate direction when the corresponding relay is energized.

The protective portion of the circuit hereinafter described includes primary means for stopping motor 68 in the event it becomes overheated, but preferably the drive portion includes back-up means effective for this purpose in the event the primary means fails to operate. The back-up means includes current transformers 87, 88 and 89 associated with the three power lines 72 respectively. The three current transformers are connected with heaters 90, 91 and 92 for contacts 80, 81 and 82 respectively, which are in the form of bimetallic strips. If the motor tends to overheat, the resulting increased current flow through any of the lines 72 induces an increased current through the winding of one of the current transformers 87, 88 and 89, energizes the corresponding heater 90, 91 and 92, and opens the corresponding contacts 80, 81 or 82. Relay D or U immediately is deenergized if any set of these contacts open, whereupon motor 68 stops.

PROTECTIVE PORTION OF CIRCUIT

Figure 9:
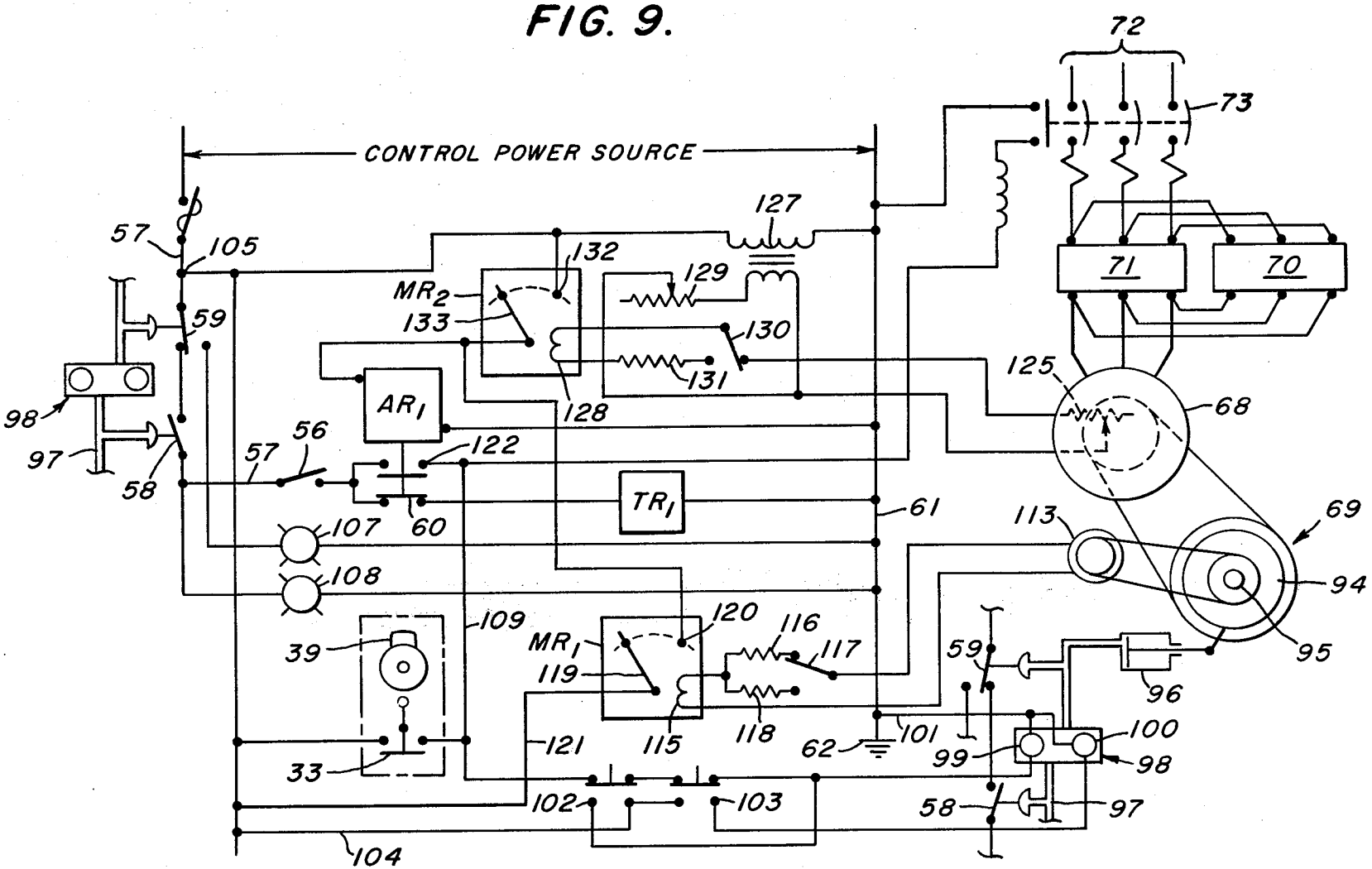
FIG. 9 is a schematic wiring diagram of the protective portion of the circuit embodied in the mechanism.

As shown in FIG. 9, the protective portion of the circuit includes a brake 94 cooperable with an input shaft 95 of the gear reducer 69, an air cylinder 96 for operating the brake, a compressed air supply line 97 connected to the cylinder, and a solenoid valve 98 in this line. Valve 98 has a "set brake" solenoid 99 and a "release brake" solenoid 100. I connect one side of each solenoid via a conductor 101 to the aforementioned ground 62. I connect the other side of solenoid 99 to normally open contacts of a "brake-on" switch 102 and the other side of solenoid 100 to normally open contacts of a "brake-off" switch 103. Switches 102 and 103 are both manually actuated push-button switches and are of the double-pole, double-throw type, having also normally closed contacts, the purpose of which is described hereinafter. I connect one of the normally open contacts of each switch via a conductor 104 to a junction point 105 in conductor 57 preceding the pressure switches 58 and 59. Thus, whenever either switch 102 or 103 is depressed, the corresponding solenoid 99 or 100 is energized to set or release the brake. The solenoid valve 98 remains in the position in which it is last placed (brake on or brake off) until the other solenoid is energized to shift it to the other positions.

When brake 94 is released, the contacts of the pressure switch 59 are in the normal position illustrated. When the brake is set, the normally closed contacts of the switch open, and the normally open contacts thereof close. When the air pressure in the line 97 is above the predetermined minimum, the pressure switch 58 closes; otherwise this switch remains open as illustrated. Hence closing the "on-off" switch 56 is ineffective to start the apparatus unless brake 94 is released and unless the air pressure in line 97 is sufficient to operate the brake if need arises. Preferably I connect a red signal light 107 across the normally open contacts of switch 59 and conductor 61, whereby the red signal shows when the brake is set. Preferably I connect a green signal light 108 across conductors 57 and 61, whereby the green shows when the brake is released and the air pressure sufficient. It should be noted that FIG. 9 shows the solenoid valve 98 and switches 58 and 59 duplicated for the purpose of simplifying the illustration. In the actual mechanism there is only one of each.

The aforementioned overtravel switch 33 affords means for shutting down the apparatus in the event the parts travel beyond proper limits. I connect one side of switch 33 to the junction point 105 and the other side of this switch to the "set brake" solenoid 99. The normally closed contacts of the "brake-on" and "brake-off" switches 102 and 103 are in series between the overtravel switch 33 and the "set-brake" solenoid 99. I also connect the overtravel switch via a conductor 109 to the main circuit breaker 73 of the drive circuit. Thus whenever cam 39 closes the overtravel switch 33, the "set brake" solenoid is energized to apply the brake 94 and the main circuit breaker 73 trips to interrupt the current path to motor 68. The purpose of the normally closed contacts of switch 102 is to prevent tripping the circuit breaker when I apply the brake by manual actuation of the switch. If the overtravel switch 33 were connected directly to solenoid 99, manual actuation of switch 102 would complete a current path via conductors 104 and 109 to the circuit breaker.

The protective portion of the circuit also includes means for shutting down the apparatus in the event it commences to operate at excessive speed, as may occur, for example, if the load is suddenly removed by a break in the rod string or cables. Such means includes an alternator 113 and a magnetic contact meter relay $MR_1$. The latter is a known device available commercially. One example of a suitable device is available from LFE Corporation, Process Controls Division, Waltham, Massachusetts, Model 202M. I mechanically connect the alternator with shaft 95 to be driven at a speed proportional to the shaft speed. $MR_1$ has a coil 115 which I connect in series with a resistor 116 and a manually operated double throw switch 117 across the output terminals of the alternator. I connect a second registor 118 to switch 117 in parallel with resistor 116 to be used for test purposes, as hereinafter explained. $MR_1$ has a pivoted contact arm 119 and a contact button 120. I connect arm 119 with conductor 57 via a conductor 121 and junction point 105. I connect button 120 with one side of the coil of a first auxiliary relay $AR_1$, and the other side of this coil via the conductor 61 to the ground 62. $AR_1$ includes the aforementioned normally closed contacts 60 and normally open contacts 122. I connect one side of contacts 122 to conductor 57 following the "on-off" switch 56, and the other side of these contacts to the circuit breaker 73, and via conductor 109 to the "set-brake" solenoid 99.

As long as shaft 94 turns at a proper speed, the alternator 113 generates a relatively low voltage. The resulting current passing through coil 115 is insufficient to produce a magnetic field strong enough to pull arm 119 into contact with button 120. If the shaft turns at an excessive speed, the voltage and current increase, whereupon arm 119 is pulled into contact with button 120, and a current path is completed through the coil of $AR_1$. $AR_1$ is energized and contacts 60 open to deenergize $TR_1$ and thus interrupt the current path to conductor 64 or 65 (FIG. 7). Contacts 122 close and complete current paths which trip the circuit breaker 73 and energize the "set brake" solenoid 99. Arm 119 of $MR_1$ is held magnetically in contact with button 120 until released manually; hence relay $AR_1$ remains energized. Resistor 118 is smaller than resistor 116. I manually throw switch 117 to cut in resistor 118 and cut out resistor 116 to test the circuit and make certain it is operative.

The protective portion of the circuit also includes the primary means hereinbefore mentioned for shutting down the apparatus in the event motor 68 overheats. Such means includes thermistors 125 (only one shown) within the motor, a second magnetic contact meter relay $MR_2$ similar to $MR_1$, and a transformer 127. I connect the primary winding of the transformer across conductors 57 and 61 to energize the transformer. $MR_2$ has a coil 128 which I connect in series with a variable resistor 129 across the secondary winding of the transformer. I connect the thermisters 125 and a double-throw switch 130 in series across the secondary winding of the transformer to provide a current path in parallel with the path through coil 128 and resistor 129. I connect a second resistor 131 to switch 130 in parallel with the thermistors for test purposes, as hereinafter explained. $MR_2$ has a contact button 132 and a pivoted contact arm 133, which I connect respectively to conductor 57 and to one side of the coil of $AR_1$.

As long as motor 68 remains at a proper temperature, the electrical resistance of the thermistors 125 is relatively low. The current induced in the secondary winding of transformer 127 passes through the parallel thermistors 125 and coil 128. The fraction which passes through the coil is insufficient to produce a magnetic field strong enough to pull arm 133 into contact with button 132. If the motor overheats, the electrical resistance of the thermistors greatly increases. Less current flows through the thermistors and more through coil 128, whereupon arm 133 is pulled into contact with button 132, and a current path is completed through the coil of $AR_1$. The action of $AR_1$ in shutting down the apparatus is the same as when $AR_1$ is energized in response to excessive speed. Switch 130 may be thrown to cut in resistor 131 and cut out the thermistors 125 to test the circuit and make certain it is operative.

ALTERNATIVE PROTECTIVE PORTION OF CIRCUIT

Figure 10:
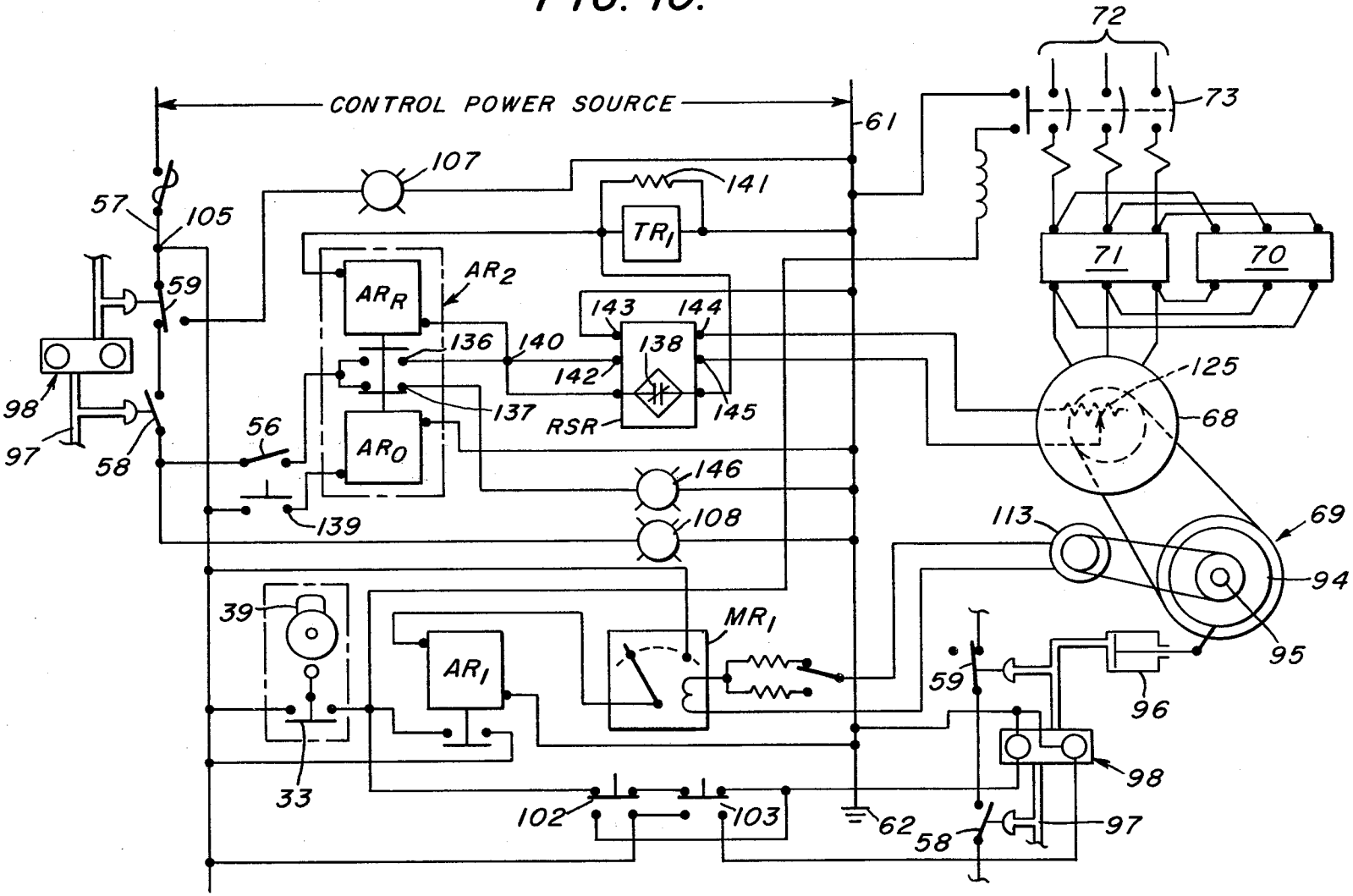
FIG. 10 is a schematic wiring diagram of the protective portion illustrating an alternative means for shutting down the apparatus in the event the motor overheats.

FIG. 10 shows a modified protective portion which embodies an alternative primary means for shutting down the apparatus in the event the motor overheats. The remainder of the circuit is similar to that already described; hence I do not repeat the description. The alternative means includes a second auxiliary relay $AR_2$ and a resistance-sensitive relay RSR. $AR_2$ is a latchtype relay similar to CR and has operating and release coils $AR_O$ and $AR_R$ respectively, normally open contacts 136 (which replace contacts 60 of FIG. 9) and normally closed contacts 137. RSR is a known device available commercially. One example of a suitable device is available from Westinghouse Electric Corporation, as the "Guardistor" motor protective solid state relay. RSR has a normally closed solid state switch 138.

I connect $AR_O$ across conductors 57 and 61 in series with a normally open push-button switch 139. To start the apparatus I close switch 56 and momentarily close switch 139. Closing switch 139 energizes $AR_O$, whereupon contacts 136 close and latch, completing a current path from conductor 57 through switch 56, and contacts 136 to a junction point 140. From 140 current flows: (a) through RSR via two of its terminals 142 and 143 to conductor 61 and ground 62, setting up RSR; (b) through the closed solid state switch 138 of RSR and the coil of $TR_1$ to conductor 61; and (c) through $AR_R$ to the coil of $TR_1$. $TR_1$ commences to time and operates as before. As long as motor 68 does not become overheated, the current which flows through $AR_R$ is insufficient to energize it.

When RSR is set up, low voltage direct current flows through a path defined by two other of its terminals 144 and 145 and the thermistors 125. If motor 68 overheats, the resulting increase in the resistance of this last current path causes switch 138 to open, whereupon there is an increase in the current in the parallel path through $AR_R$ sufficient to energize $AR_R$. I connect a resistor 141 in parallel with the coil of $TR_1$, the purpose of which is to increase the load on $AR_R$ over that permitted by the coil of $TR_1$ alone. Energizing $AR_R$ opens contacts 136 and closes contacts 137, deenergizing $TR_1$. Contacts 137 are connected in series with a brake light 146, which now shows. $AR_2$ latches in the position shown when $AR_R$ is energized. The apparatus cannot start again until $AR_O$ is energized by momentarily closing switch 139.

In the form of the protective portion of the circuit shown in FIG. 9, the circuit breaker 73 trips and the brake 94 is applied in the event the motor overheats. In the form shown in FIG. 10, these actions do not take place, since they are not essential to proper protection of the apparatus. If the parts travel beyond proper limits or if the speed becomes excessive, it is essential to deenergize the motor and apply the brake immediately to prevent damage to the apparatus. If the motor overheats, it is sufficient merely to shut off the motor and let the parts come to a stop, since there is no likelihood of damaging the apparatus.

From the foregoing description it is seen that my invention affords a fully reliable circuit for controlling an electrically operated reciprocating apparatus, such as a longstroke pumping apparatus. The mechanism avoids use of relays which are required to operate in sequence, and it assures that the apparatus travels in the most advantageous direction on start-up. The apparatus is fully protected against malfunctions which are likely to occur.

I claim:

1. In an electrically operated reciprocating apparatus which has a drive and control mechanism including a reversible drive motor, a drive circuit operatively connected with said motor, and a control circuit operatively connected with said drive circuit to energize said motor alternately in opposite directions, said control circuit including switch means operated near the ends of movement of the apparatus in each direction as it reciprocates, the improvement in which said control circuit comprises:

a latch-type relay which includes contacts movable to a first position for completing a current path to said drive circuit to energize said motor in one direction and to a second position for completing a current path to said drive circuit to energize said motor in the opposite direction;

said relay including an operating coil operatively connected with said switch means for moving said contacts to their first position following operation of said switch means near the end of movement of the apparatus in one direction, means for latching said contacts in their first position and a reversing coil operatively connected with said switch means for releasing said latching means and moving said contacts to their second position following operation of said switch means near the end of movement of the apparatus in the other direction; and directional control means operatively connected with said relay for starting said apparatus moving in a predetermined direction depending on the positon of the apparatus at the time it is started.

2. An improvement as defined in claim 1 in which said apparatus is a long-stroke pumping apparatus which includes means for connection to a string of sucker rods and means for connection to a counterbalance to be driven in opposite directions.

3. An improvement as defined in claim 1 in which the means for energizing said coils includes time delay means for interrupting both said current paths for an interval at each end of the movement of said apparatus.

4. An improvement as defined in claim 1 in which said directional control means includes switch means operated by said apparatus at a central point of its movement in both directions, whereby the direction of movement at start-up is toward the farther limit of travel.

5. An improvement as defined in claim 1 comprising in addition protective means operatively connected with said control circuit for shutting down the apparatus automatically in the event of a malfunction.

6. In an electrically operated reciprocating apparatus which has a drive and control mechanism including a reversible drive motor, a drive circuit operatively connected with said motor and a control circuit operatively connected with said drive circuit for enabling said drive circuit to energize said motor alternately in opposite directions, said control circuit including switch means operated near the ends of movement of the apparatus in opposite directions as it reciprocates to effect reversals, the improvement in which said control circuit comprises:

directional control means effective on start-up of the apparatus to start the apparatus traveling always in a direction toward its farther limit of travel.

7. An improvement as defined in claim 6 in which said directional control means includes switch means operated at approximately the midpoint of the travel of said apparatus, and means operatively connected with said last-named switch means for setting said control circuit to operate in the intended direction when started after a shut-down.

8. An improvement as defined in claim 6 in which said directional control means includes switch means operated at approximately the midpoint of the travel of said apparatus, and in which said control circuit comprises in addition contacts movable to a first position for completing a current path to said drive circuit to energize said motor in one direction and to a second position for completing a current path to energize said motor in the opposite direction, and means connected with said second-named switch means and said contacts for positioning said contacts on start-up to energize said motor in the intended direction.

9. An improvement as defined in claim 8 in which said control circuit comprises in addition means for latching said contacts in their first position when moved thereto, and means connected with said first-named switch means for moving said contacts to their first position and latching them therein following operation of said first-named switch means near the end of movement of the apparatus in one direction, and for releasing the latch and moving said contacts to their second position following operation of said first-named switch means near the end of movement of the apparatus in the other direction.

10. An improvement as defined in claim 6 comprising in addition protective means operatively connected with said control circuit for shutting down the apparatus in the event of a malfunction.

11. An improvement as defined in claim 10 in which the malfunctions effective for shutting down the apparatus include travel of the apparatus beyond its normal limits, travel of the apparatus at excessive speed, or overheating of said drive motor.

12. In a long-stroke pumping apparatus which includes a drum, means rotatably supporting said drum, a reversible motor operatively connected with said drum for driving it alternately in opposite directions, a pair of cables connected to said drum, each of which winds thereon while the other unwinds therefrom, and a rod string and a counterbalance connected to the respective cables to reciprocate up and down in opposite directions, the combination therewith of an improved control mechanism comprising:

means for stopping said motor as said rod string and counterbalance approach the limits of their travel in each direction and energizing said motor in the opposite direction as said rod string and counterbalance start their travel in the other direction; and directional control means effective on start up of the apparatus to start said rod string and said counterbalance always traveling toward their farther limits of travel.

13. A combination as defined in claim 12 in which said directional control means includes a switch operated by said apparatus at approximately the midpoint of travel of said rod string and said counterbalance.

14. A combination as defined in claim 12 in which said control mechanism comprises in addition protective means effective to shut down the apparatus in the event said rod string and said counterbalance travel beyond proper limits.

15. A combination as defined in claim 12 in which said control mechanism comprises in addition protective means effective to shut down the apparatus in the event said rod string and said counterbalance commence to operate at excessive speed.

16. A combination as defined in claim 12 in which said control mechanism comprises in addition protective means effective to shut down the apparatus in the event said motor overheats.

17. A combination as defined in claim 12 in which said control mechanism includes a latch-type relay for latching its contacts in a position to drive said motor in different directions to avoid dependence on series of relays which operate in sequence.

18. In an electrically operated reciprocating apparatus which has a drive and control mechanism including a reversible drive motor, a drive circuit operatively connected with said motor, and a control circuit operatively connected with said drive circuit to energize said motor alternately in opposite directions, said control circuit comprising:

switch means operated near the ends of movement of the apparatus in each direction as it reciprocates;

contacts movable to a first position for completing a current path to said drive circuit to energize said motor in one direction and to a second position for completing a current path to said drive circuit to energize said motor in the opposite direction;

means for latching said contacts in their first position when moved thereto; and means connected with said switch means for moving said contacts to their first position and latching them therein following operation of said switch means near the end of movement of the apparatus in one direction and for releasing said latching means and moving said contacts to their second position following operation of said switch means near the end of movement of the apparatus in the other direction;

the combination therewith of:

protective means including a brake operatively connected with said apparatus, a compressed air supply for operating said brake, and means operatively connected with said air supply for preventing operation of said apparatus in the event the pressure of said air supply is below a predetermined minimum.

19. In an electrically operated reciprocating apparatus which has a drive and control mechanism including a reversible drive motor, a drive circuit operatively connected with said motor, and a control circuit operatively connected with said drive circuit to energize said motor alternately in opposite directions, said control circuit comprising:

switch means operated near the ends of movement of the apparatus in each direction as it reciprocates;

contacts movable to a first position for completing a current path to said drive circuit to energize said motor in one direction and to a second position for completing a current path to said drive circuit to energize said motor in the opposite direction;

means for latching said contacts in their first position when moved thereto; and means connected with said switch means for moving said contacts to their first position and latching them therein following operation of said switch means near the end of movement of the apparatus in one direction and for releasing said latching means and moving said contacts to their second position following operation of said switch means near the end of movement of the apparatus in the other direction;

the combination therewith of:

protective means including overtravel switch means operated by said apparatus on travel beyond its normal limits, and means operatively connected with said overtravel switch means for shutting down said apparatus in the event it travels beyond normal limits.

20. In an electrically operated reciprocating apparatus which has a drive and control mechanism including a reversible drive motor, a drive circuit operatively connected with said motor, and a control circuit operatively connected with said drive circuit to energize said motor alternately in opposite directions, said control circuit comprising:

switch means operated near the ends of movement of the apparatus in each direction as it reciprocates;

contacts movable to a first position for completing a current path to said drive circuit to energize said motor in one direction and to a second position for completing a current path to said drive circuit to energize said motor in the opposite direction;

means for latching said contacts in their first position when moved thereto; and means connected with said switch means for moving said contacts to their first position and latching them therein following operation of said switch means near the end of movement of the apparatus in one direction and for releasing said latching means and moving said contacts to their second position following operation of said switch means near the end of movement of the apparatus in the other direction;

the combination therewith of:

protective means including an alternator driven at a speed proportional to the speed of the apparatus and means operatively connected with said alternator for shutting down said apparatus in the event its speed becomes excessive.

21. In an electrically operated reciprocating apparatus which has a drive and control mechanism including a reversible drive motor, a drive circuit operatively connected with said motor, and a control circuit operatively connected with said drive circuit to energize said motor alternately in opposite directions, said control circuit comprising:

switch means operated near the ends of movement of the apparatus in each direction as it reciprocates;

contacts movable to a first position for completing a current path to said drive circuit to energize said motor in one direction and to a second position for completing a current path to said drive circuit to energize said motor in the opposite direction;

means for latching said contacts in their first position when moved thereto; and means connected with said switch means for moving said contacts to their first position and latching them therein following operation of said switch means near the end of movement of the apparatus in one direction and for releasing said latching means and moving said contacts to their second position following operation of said switch means near the end of movement of the apparatus in the other direction;

the combination therewith of:

protective means including temperature sensing means in said motor, and means operatively connected with said temperature sensing means for shutting down said apparatus in the event said motor overheats.

22. In an electrically operated reciprocating apparatus which has a drive and control mechanism including a reversible drive motor, a drive circuit operatively connected with said motor, and a control circuit operatively connected with said drive circuit to energize said motor alternately in first and second opposite directions, said control circuit including switch means operated near the ends of movement of the apparatus in each direction as it reciprocates, the improvement in which said control circuit comprises:

a first time delay means operatively connected with said switch means and with said drive circuit and being operable when said switch means operates near the end of movement of said apparatus in the first direction to delay energizing said motor in the second direction for a predetermined interval; and a second time delay means operatively connected with said switch means and with said drive circuit and being operable when said switch means operates near the end of movement of said apparatus in the second direction to delay energizing said motor in the first direction for a predetermined interval,

23. In a long-stroke pumping apparatus which includes a rod string, and a counterbalance, means supporting said rod string and said counterbalance for movement up and down in opposite directions, a reversible electrically operated motor for driving said rod string and said counterbalance, a drive circuit operatively connected with said motor, and a control circuit operatively connected with said drive circuit to energize said motor alternately in opposite directions to raise said counterbalance and lower said rod string and vice versa, said control circuit including switch means operated near the ends of movement of said counterbalance in each direction, the improvement in which said control circuit comprises:

a first time delay means operatively connected with said switch means and with said drive circuit and being operable when said switch means operates near the end of the movement of said counterbalance upwardly to delay energizing said motor to drive said rod string upwardly for a predetermined interval while said counterbalance commences to descend under its own weight; and a second time delay means operatively connected with said switch means and with said drive circuit and being operable when said switch means operates near the end of the movement of said counterbalance downwardly to delay energizing said motor to drive said counterbalance upwardly for a predetermined interval while said rod string commences to descend under its own weight.

* * * * *